US012509885B2

(12) United States Patent
Koreman

(10) Patent No.: US 12,509,885 B2
(45) Date of Patent: Dec. 30, 2025

(54) SUPPORT LAYER CONFIGURED TO PROVIDE ACOUSTIC AND/OR THERMAL INSULATION

(71) Applicant: BLACE INTERNATIONAL B.V., Terneuzen (NL)

(72) Inventor: Yannick Koreman, Terneuzen (NL)

(73) Assignee: BLACE INTERNATIONAL B.V., Terneuzen (NL)

( * ) Notice: Subject to any disclaimer, the term of this patent is extended or adjusted under 35 U.S.C. 154(b) by 185 days.

(21) Appl. No.: 18/575,981

(22) PCT Filed: Jul. 7, 2022

(86) PCT No.: PCT/NL2022/050393
§ 371 (c)(1),
(2) Date: Jan. 2, 2024

(87) PCT Pub. No.: WO2023/282748
PCT Pub. Date: Jan. 12, 2023

(65) Prior Publication Data

US 2024/0309656 A1 Sep. 19, 2024

(30) Foreign Application Priority Data

Jul. 7, 2021 (NL) ..... 2028653

(51) Int. Cl.
*E04F 15/18* (2006.01)

(52) U.S. Cl.
CPC ..... *E04F 15/185* (2013.01)

(58) Field of Classification Search
CPC ..... E04F 15/225; E04F 15/185
(Continued)

(56) References Cited

U.S. PATENT DOCUMENTS 4,879,857 A * 11/1989 Peterson ..... E04F 15/225 52/480
5,950,378 A * 9/1999 Council ..... E01C 13/045 52/180

(Continued)

FOREIGN PATENT DOCUMENTS

KR 100873425 B1 12/2008
KR 101487374 B1 1/2015

OTHER PUBLICATIONS

PCT International Search Report dated Sep. 14, 2022; PCT/NL2022/050393.

*Primary Examiner* — Paola Agudelo
(74) *Attorney, Agent, or Firm* — Suiter Swantz IP

(57) ABSTRACT

The invention relates to a support layer configured to provide acoustic and/or thermal insulation, comprising: —a base layer comprising a first side configured to be placed against a boundary surface of a space, and a second side configured to face away from said boundary surface and to be directed towards a cover layer; —a set of primary carriers configured to carry the cover layer, wherein said primary carriers are resilient and extend a first distance from at least one of the first side and the second side of the base layer; and —a set of auxiliary carriers configured to additionally carry the cover layer when the primary carriers are compressed due to a load being exerted on the cover layer, wherein said auxiliary carriers extend a second distance, that is smaller than the first distance, from the same at least one of the first side and the second side of the base layer.

20 Claims, 5 Drawing Sheets

(58) Field of Classification Search
USPC ..... 52/177, 592.1
See application file for complete search history.

(56) References Cited

U.S. PATENT DOCUMENTS

| | | | | |
|---|---|---|---|---|
| 6,029,962 | A * | 2/2000 | Shorten | B29C 66/1312 267/145 |
| 6,878,430 | B2 * | 4/2005 | Milewski | E04F 15/10 52/180 |
| 7,900,416 | B1 * | 3/2011 | Yokubison | E04F 15/087 52/592.1 |
| 10,711,469 | B2 * | 7/2020 | Brown | E01C 13/045 |
| 10,842,303 | B1 * | 11/2020 | Vieveen | A47G 27/0218 |
| 2015/0376904 | A1 * | 12/2015 | Huss | E04F 15/02038 52/745.13 |
| 2018/0223543 | A1 * | 8/2018 | Faotto | B32B 27/065 |
| 2019/0338535 | A1 * | 11/2019 | Sennik | E04F 15/0215 |
| 2020/0141132 | A1 * | 5/2020 | Cormier | A47G 27/02 |
| 2020/0392743 | A1 * | 12/2020 | Bennett | E04B 5/48 |
| 2022/0178151 | A1 * | 6/2022 | Sennik | B32B 29/007 |
| 2024/0003143 | A1 * | 1/2024 | Audi | E04F 15/185 |

* cited by examiner

SUPPORT LAYER CONFIGURED TO PROVIDE ACOUSTIC AND/OR THERMAL INSULATION

TECHNICAL FIELD AND BACKGROUND

The present invention relates to a support layer that is configured to provide acoustic and/or thermal insulation, in particular to a boundary surface of a space.

Such a space may be a housing, such as a housing of an apparatus or an engine room of e.g. a ship, but in particular such a space may be an inner space, such as a room, of a building. The space is surrounded by one or more than one boundary surface, which, in case of a room inside a building, comprises the floor, the side walls and the ceiling.

Thermal insulation may be related to all boundary surfaces of a space, with perhaps a slight priority to a ceiling because of the tendency of heat to rise. To the contrary, acoustic insulation will normally be of a higher priority to a floor, due to contact noises that may be transferred to other spaces, especially located below the space to be insulated. Reducing the sounds from floors above is especially relevant in multi story buildings, such as flats and apartments.

Better insulation may be achieved by making the material very thick, but for a floor, this would require adaptations to the frames and doors to be done, which in practice often leads to a user agreeing to a poorer insulation. With respect to poorer acoustic insulation, this may lead to nuisance especially to users of underlying spaces.

United States patent application US 2020/141132 A1 and Korean patent applications KR 100873425 and KR 101487374 are acknowledged as prior art.

BRIEF SUMMARY

An objective of the present invention is to provide a support layer, that is improved relative to the prior art and wherein at least one of the above stated problems is obviated or alleviated. There is especially an ongoing need to further improve the efficiency of acoustic and/or thermal insulation, and preferably both at the same time.

Said objective is achieved with the support layer configured to provide acoustic and/or thermal insulation according to claim 1 of the present invention, comprising:

- a base layer comprising a first side configured to be placed against a boundary surface of a space, and a second side configured to face away from said boundary surface and to be directed towards a cover layer;
- a set of primary carriers configured to carry the cover layer, wherein said primary carriers are resilient and extend a first distance from at least one of the first side and the second side of the base layer; and
- a set of auxiliary carriers configured to additionally carry the cover layer when the primary carriers are compressed due to a load being exerted on the cover layer, wherein said auxiliary carriers extend a second distance, that is smaller than the first distance, from the same at least one of the first side and the second side of the base layer.

One practical application of the support layer according to the invention that will be described for explaining the functionality is using the support layer as a floor underlayment. In this case, the cover layer will be a floor covering, and the boundary surface will be defined by a subfloor of a building. More in particular the floor covering, also known as finish floor, is available in many types, and may be a solid wood, a laminate, a carpet, a vinyl layer or even a ceramic tile. The subfloor may be interpreted as the structural floor that supports a flooring, and may in many cases be a concrete slab floor of a building.

Although the primary carriers and the auxiliary carriers may be arranged on either one, or even both, of the first side and the second side of the base layer, said primary and auxiliary carriers are preferably at least arranged on the first side of the base layer that is configured to be placed against the boundary surface of the space. This preferred configuration, wherein the base layer is intermediate the primary and auxiliary carriers on the one hand, and the cover layer on the other hand, will be described in the next paragraphs for elucidating the invention in more detail. In this embodiment, the primary and auxiliary carriers carry the cover layer via the base layer there between. The skilled person will however understand that primary and auxiliary carriers arranged on the second side of the base layer would carry, i.e. support, the cover layer directly, which is a feasible alternative or addition.

The invention is now first described for the configuration wherein the primary carriers and the auxiliary carriers are both arranged on the first side of the base layer, and said carriers are therefore directed towards the boundary surface. The cover layer rests on the base layer, that is arranged intermediate the cover layer and the primary and auxiliary carriers. The primary and auxiliary carriers thus carry the base layer and the cover layer, i.e. said carriers carry the cover layer via the base layer.

If the cover layer is placed on the support layer, either directly or indirectly, it will be carried, relative to the boundary surface, solely by the primary carriers as long as the load exerted on the cover layer does not exceed a threshold force. Exceeding this threshold force would cause the primary carriers, that are resilient, to compress to a compressed length of the primary carriers that is equal to the second distance that the set of auxiliary carriers is extending from the same (first) side of the base layer. However, as long as the load exerted on the cover layer does not exceed the above mentioned threshold force, the primary carriers are perfectly capable of carrying the cover layer (via the base layer) relative to the boundary surface, and consequently the total contact area over which heat and/or sound may be transferred via physical contact from the cover layer to the boundary surface is limited the total contact area the primary carriers have with the boundary surface.

However, once the above mentioned threshold force is exceeded by a load being exerted locally on the cover layer, for example due to a heavy piece of furniture or one or more than one person standing on the cover layer, the primary carriers at that specific location will be compressed, and the base layer will move towards the boundary surface until the auxiliary carriers that extend over a second distance from said base layer also come into contact with the boundary surface. Thus, when the primary carriers as such are not capable of carrying the cover layer due to a (local) load exerted on said cover layer, the auxiliary carriers will automatically be involved in carrying the cover layer together with the primary carriers. As soon as the auxiliary carriers come into contact with the boundary surface, the total contact area over which heat and/or sound may be transferred via physical contact increases to the sum of the total contact area of the primary carriers and the total contact area of the auxiliary carriers that are in contact with the boundary surface. Please note, that this involvement of auxiliary carriers will normally be only locally, near the location where the threshold force is exceeded.

The support layer according to the invention as described above, by virtue of the primary carriers and the auxiliary carriers, is able to automatically increase the contact area available for carrying the cover layer in dependence of the actual need. Moreover, this automatic adaptation to the contact area available for carrying the cover layer is only localized, guaranteeing that the total contact area over which heat and/or sound may be transferred via physical contact from the cover layer to the boundary surface is always as low as possible, which improves the level of acoustic and/or thermal insulation, as will be explained below.

Acoustic insulation is related to contact noise that is partially transferred as a sound wave through the support layer. Consequently, a reduction in physical contact area also reduces transfer of contact noise. Moreover, the primary carriers being resilient allow them to at least partially absorb sound waves. For this reason, the auxiliary carriers and/or the base layer are preferably also resilient.

Thermal insulation is obtained via at least two mechanisms. On the one hand, a reduced physical contact area defined by the primary and auxiliary carriers reduces the so-called thermal bridge that is responsible for and directly related to the amount of heat conduction through the support layer. On the other hand, a layer of air between the cover layer and the boundary surface may provide further thermal insulation. The primary carriers and the auxiliary carriers being arranged on the same side of the base layer guarantee the presence of a layer of air having insulating properties between said side, i.e. the first side in this example, of the base layer and the boundary surface. Moreover, this layer of air will be "as thick as possible", in the sense that the primary carriers will normally function as a spacer supporting the base layer at a first distance from the boundary surface, and the distance between the base layer and the boundary surface will only reduce (locally) to the second distance when the threshold force is exceeded by a load exerted on the cover layer, requiring the auxiliary carriers to act as a local reinforcement.

Clearly, the primary carriers and the auxiliary carriers work in conjunction to obtain a synergistic effect resulting in an improved acoustic and thermal insulation.

The skilled person will understand that a similar effect may be obtained if, as an alternative or as an addition, primary carriers and auxiliary carriers of a similar type would be arranged on the second side of the base layer. In that case, the primary and auxiliary carriers could carry, i.e. support, the cover layer directly. Again, it will be guaranteed that the total contact area over which heat and/or sound may be transferred via physical contact from the cover layer to the boundary surface is always as low as possible, because the physical contact between the cover layer and the base layer of the support layer will now be limited to the sum of the total contact area of the primary carriers and the total contact area of the auxiliary carriers that are in physical contact with the cover layer.

The primary carriers and the auxiliary carriers can be spaced apart from each other along the base layer.

The base layer can comprise recesses to define cells and walls between said cells. The primary carriers may then extend from the walls of the base layer. Further, the auxiliary carriers may extend from the walls of the base layer. The walls may form a further set of auxiliary carriers. If the primary carriers, the set of auxiliary carriers, and the further set of auxiliary carriers extend different distances from the at least one of the first side and the second side of the base layer, the support surface formed by the contact area will increase in a step-wise manner. The primary carriers are always active, i.e. in contact and supporting the cover layer. Dependent on the level of compression, first the set of auxiliary carriers may become active when the compression level exceeds a first threshold, while the further set of auxiliary carriers may only become active when the level of compression exceeds a second threshold that is higher than the first threshold.

According to a further preferred embodiment, the set of primary carriers and the set of auxiliary carriers, and preferably also the one or more than one further set of auxiliary carriers, are arranged on only one of the first side and the second side of the base layer.

According to an even further preferred embodiment, the other of the first side and the second side of the base layer comprises a flat surface.

According to an even further preferred embodiment, the set of primary carriers and the set of auxiliary carriers is arranged on the first side of the base layer that is configured to be placed against the boundary surface of the space.

According to an even further preferred embodiment, the set of primary carriers and the set of auxiliary carriers is arranged on the second side of the base layer that is configured to be directed towards the cover layer.

According to an even further preferred embodiment, the set of primary carriers and the set of auxiliary carriers is arranged on both the first side and the second side of the base layer.

Though it is possible to arrange primary and auxiliary carriers on both the first side as well as the second side of the base layer, this can cause stresses at intermediate positions of the base layer, risking failure of the support layer. This risk is reduced when the carriers are arranged only at one side of the base layer, with the other side preferably being a flat surface. This latter configuration also has advantageous in ease of manufacturing and more even distribution of internal stresses inside the support layer. Contrary to KR 100873425, forces related to the crumpling type of deformation are prevented.

According to an even further preferred embodiment, one or more than one of:

- a position of the primary carriers arranged on the first side of the base layer is substantially opposite to a position of the auxiliary carriers arranged on the second side of the base layer; and
- a position of the auxiliary carriers arranged on the first side of the base layer is substantially opposite to a position of the primary carriers arranged on the second side of the base layer.

According to an even further preferred embodiment, the support layer is formed in a monolithic piece.

According to an even further preferred embodiment the support layer has a thickness of up to 5 mm, preferably up to 3, more preferably up to 2 mm.

According to an even further preferred embodiment, the support layer is made of a resilient composition, preferably comprising at least one type of polymer as disclosed herein.

Preferred embodiments are the subject of the dependent claims.

The various aspects and features described and shown in the specification can be applied, individually, wherever possible. These individual aspects, and in particular the aspects and features described in the attached dependent claims, may be an invention in its own right that is related to a different problem relative to the prior art.

BRIEF DESCRIPTION OF THE DRAWINGS

In the following description preferred embodiments of the present invention are further elucidated with reference to the drawing, in which.

DETAILED DESCRIPTION

Figure 1:
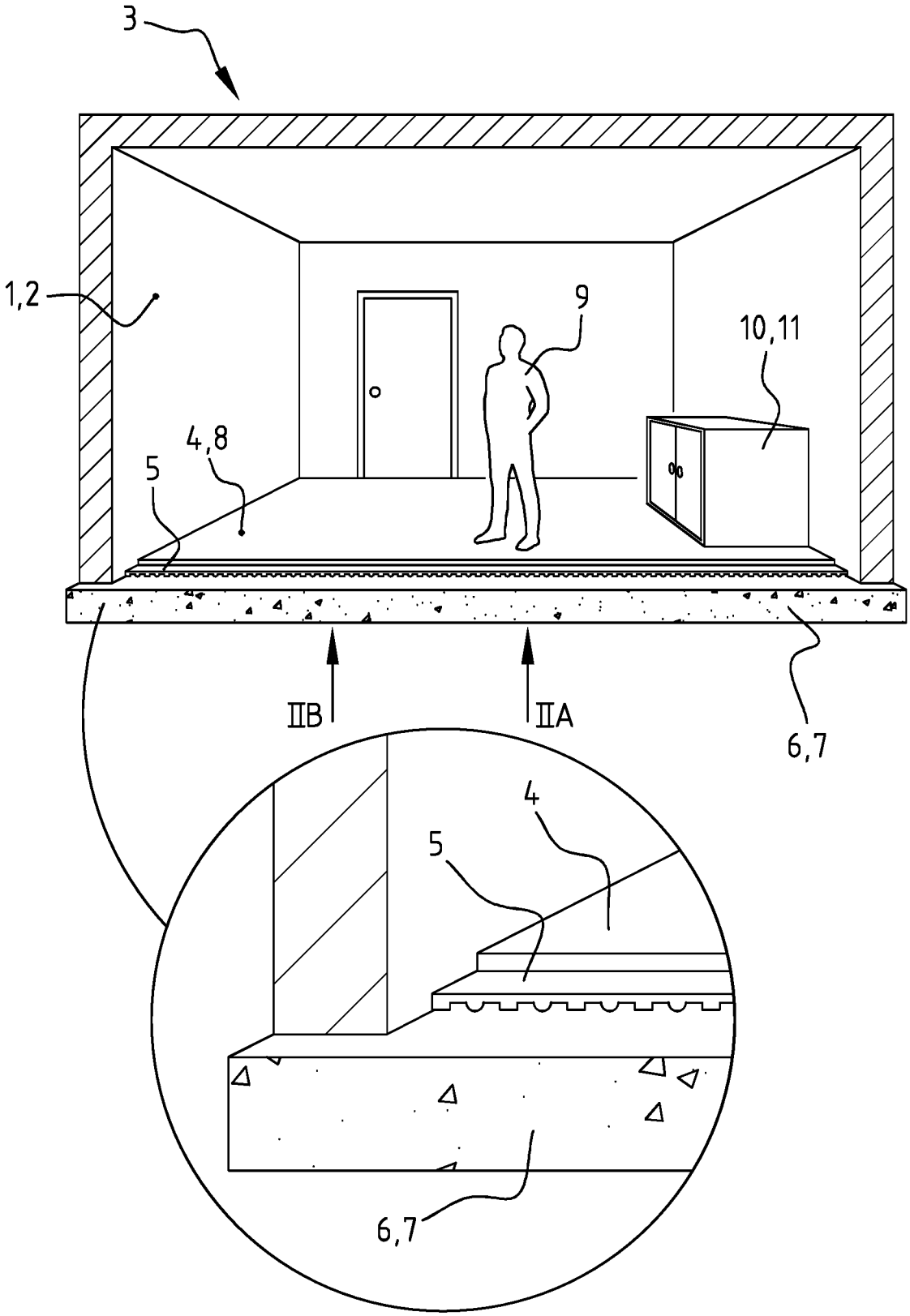
FIG. 1 is a perspective view of a room, wherein a floor covering is supported by a support layer according to the invention.

In the various embodiments, similar reference numbers apply to the similar features.

Room 2 in building 3 defines a space 1. Inside said room 2, a floor covering 4, that is also known as finish floor, is supported by a support layer 5. The support layer 5, that is configured to provide acoustic and/or thermal insulation, is arranged on a subfloor 6 of the building 3. This subfloor 6 may be interpreted as the structural floor that supports a flooring, and may in many cases be a concrete slab floor 7 of the building 3. The floor covering 4, or finish floor, is available in many types, and may be a solid wood, a laminate, a carpet, a vinyl layer or even a ceramic tile.

Figure 2A:
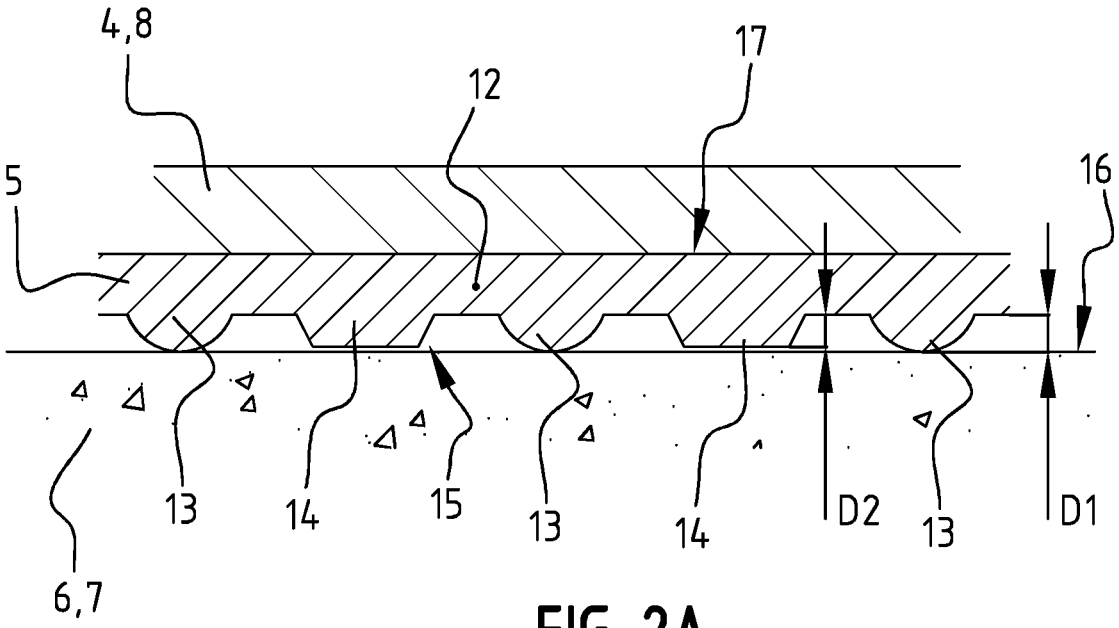
FIG. 2A is a cross-sectional view of the support layer of FIG. 1 at a substantially unloaded area of the floor.
Figure 2B:
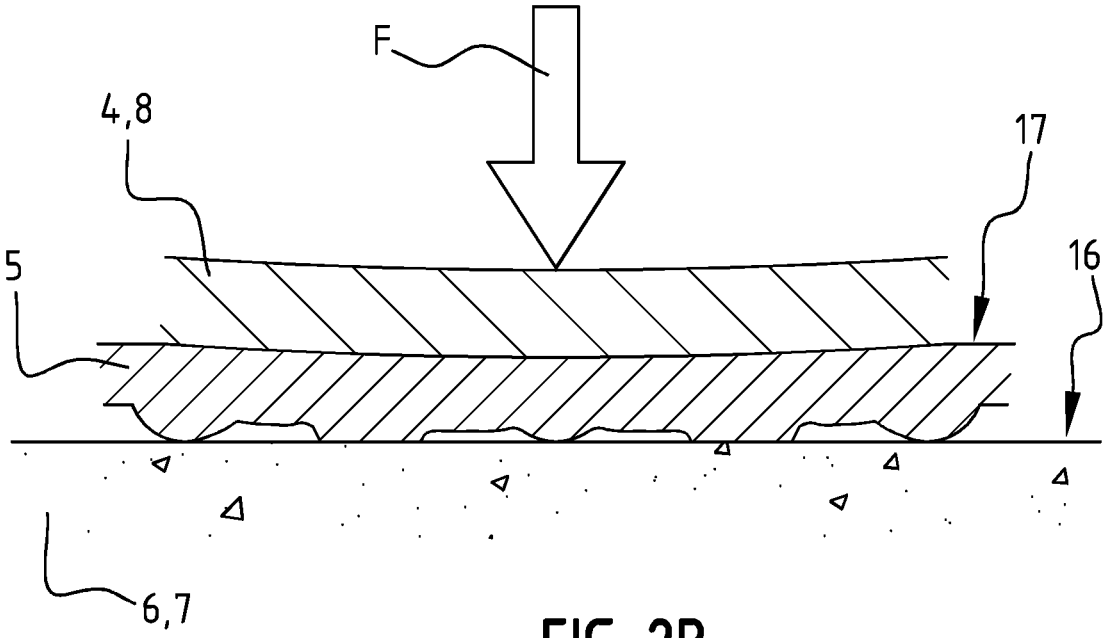
FIG. 2B is a cross-sectional view of the support layer of FIG. 1 at a substantially loaded area of the floor, e.g. due to a person standing at said area.
Figure 3:
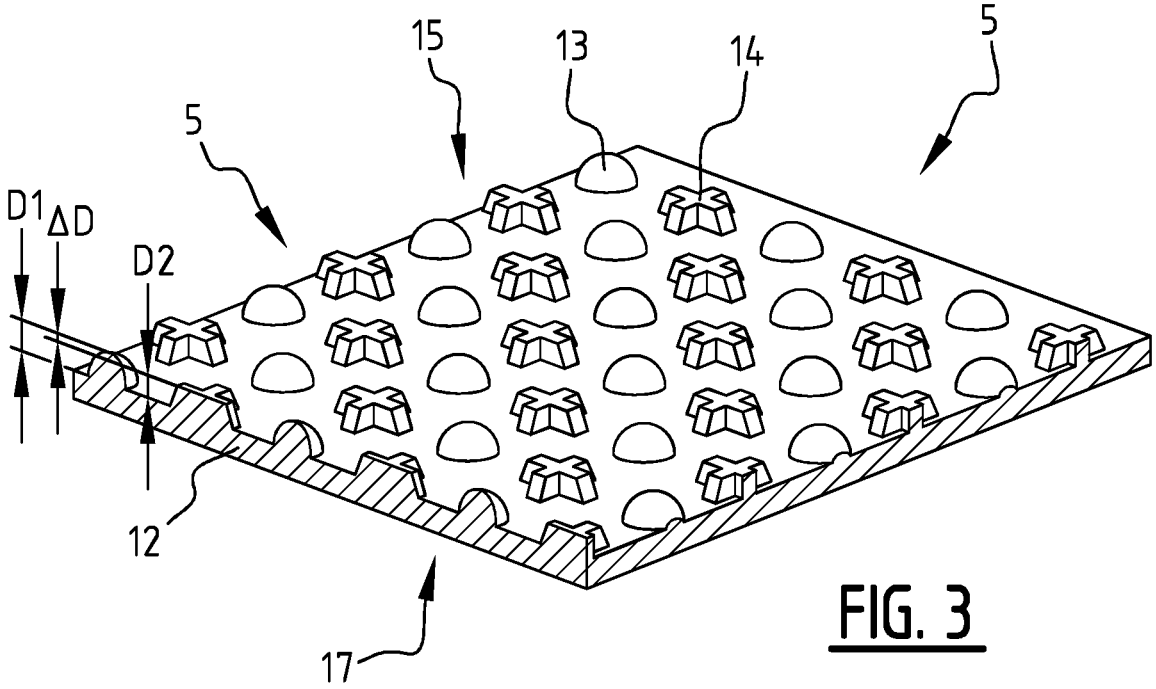
FIG. 3 is a perspective view of a support layer according to a first preferred embodiment.

Dependent on a magnitude of a load exerted on the floor covering 4, hereafter also referred to as cover layer 8, the support layer 5 will experience a compressive load. For example, in FIG. 1, the support layer 5 will experience a higher compressive load in the areas where the person 9 is standing, and where the piece of furniture 10, e.g. the cupboard 11, is placed on the cover layer 8. FIGS. 2A and 2B show detailed cross sectional views at a substantially unloaded, and a loaded are, respectively, the locations being also indicated with arrows in FIG. 1.

The support layer 5 is configured to provide acoustic and/or thermal insulation, and comprises a base layer 12, a set of primary carriers 13 and a set of auxiliary carriers 14. The base layer 12 comprises a first side 15 configured to be placed against a boundary surface 16 of a space 1, and a second side 17 configured to face away from said boundary surface 16 and to be directed towards a cover layer 8. In FIG. 1, the boundary surface 16 against which the first side 15 of the support layer 5 is placed is defined by the subfloor 6, i.e. the concrete slab floor 7 of the building 3.

The set of primary carriers 13 is configured to carry the cover layer 8, wherein said primary carriers 13 are resilient and extend a first distance D1 from at least one of the first side 15 and the second side 17 of the base layer 12.

The set of auxiliary carriers 14 is configured to additionally carry the cover layer 8 when the primary carriers 13 are compressed due to a load being exerted on the cover layer 8, wherein said auxiliary carriers 14 extend a second distance D2, that is smaller than the first distance D1, from the at least one of the first side 15 and the second side 16 of the base layer 12.

The first distance D1 and the second distance D2 are to be interpreted for the support layer 5 with the respective primary carriers 13 and auxiliary carriers 14 being in a substantially uncompressed state. The difference ΔD in the first distance D1 and the second distance D2 is also visible in the substantially unloaded situation shown in FIG. 2A, although the primary carriers 13 already carry the cover layer 8 and may therefore be slightly compressed. Of course, a difference first distance D1 and the second distance D2 may also be inspected when the support layer 5 is in a resting state and not yet in use for supporting the cover layer 8. When the support layer 5 is not yet in use, it will be fully uncompressed.

In the embodiments shown in FIGS. 1-6, the primary carriers 13 and the auxiliary carriers 14 extend from the first side 15, i.e. the respective side of the base layer 12 that is directed towards the boundary surface 16, i.e. subfloor 6. The floor covering 4 defines the cover layer 8. It is however explicitly mentioned here that the primary carriers 13 and auxiliary carriers 14 may also—as an alternative or as additional primary and auxiliary carriers 13, 14—extend from the second side 17 of the base layer 12. In both cases, the primary and auxiliary carriers 13, 14 carry the cover layer 8.

Figure 8:
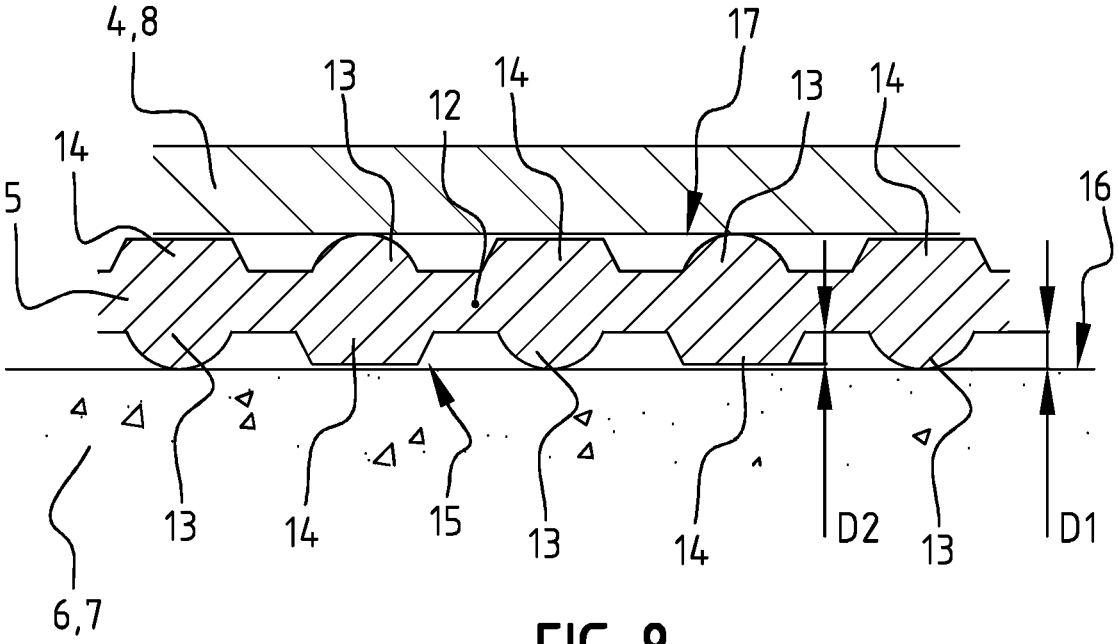
FIG. 8 is a cross-sectional view of a support layer according to a fifth preferred embodiment comprising sets of primary carriers and sets of auxiliary carriers arranged on both the first side and the second side of the base layer.

In the embodiment shown in FIGS. 1, 2A and 2B, the primary carriers 13 and auxiliary carriers 14 carry the cover layer 8 via the base layer 12 that is arranged in between the cover layer 8 (on top) and the boundary surface 16 (below). The set of primary carriers 13 and the set of auxiliary carriers 14 are thus arranged on the first side 15 of the base layer 12, wherein this first side 15 is configured to be placed against the boundary surface 6 of the space 1. The skilled person will however understand that primary and auxiliary carriers 13, 14 may be arranged on the second side 17 of the base layer 12, wherein said second side 17 is configured to be directed towards the cover layer 8, as an alternative or addition. Primary and auxiliary carriers 13, 14 on the second side 17 would then carry, i.e. support, the cover layer 8 directly. FIG. 8 shows an embodiment of a support layer 5 comprising sets of primary carriers 13 and sets of auxiliary carriers 14 arranged on both the first side 15 and the second side 17 of the base layer 12.

In a preferred embodiment, the one or more than one of the auxiliary carriers 14 comprises a convex outer surface facing away from the base layer 12. Due to this convex shape, the contact area of the auxiliary carriers 14 with the respective boundary surface 16 of cover layer 8 will increase gradually in dependence of the magnitude of the compressive load exerted onto the support layer 5. In this way, the convex shaped auxiliary carriers 14 guarantee that the total contact area over which heat and/or sound may be transferred via physical contact from the cover layer 8 to the boundary surface 16 and vice versa is always as low as possible, which improves the level of acoustic and/or thermal insulation.

More in general, the auxiliary carriers 14 (or indeed the further auxiliary carriers 18 described below) may comprise an outer surface facing away from the base layer 12 which is configured to increase, preferably non-linearly, its contact area against a flat surface under increasing load. Such a configuration of said outer surface, of which the convex shape is an example, causes the contact surface of the auxiliary carriers 14 to increase in a gradual and/or non-linear manner, resulting in a relatively fast increase in the contact area when the auxiliary carriers 14 are compressed. Such a fast increase allows the support layer 5 to be manufactured relatively thin. For example, a support layer 5 of about 1.6 mm in total thickness already provides sufficient thermal and acoustic insulation, while also being easy to install without requiring constructive changes. To the contrary, prior art layers provide a linear increase when the auxiliary carriers are compressed, requiring a relatively large compression to obtain an increase in contact area when the load on the support layer increases.

If an area of the set of the auxiliary carriers 14 facing away from the at least one of the first side 15 and the second side 17 of the base layer 12 is larger than an area of the set of the primary carriers 13 facing away from the same at least one of the first side 15 and the second side 17 of the base layer 12, the auxiliary carriers 14 will be able to support even high compressive loads exerted on the support layer 5. During use, wherein the support layer 5 is installed in between a boundary surface 16 and a cover layer 8, said area facing away from the respective side of the base layer 12 is the area that is available for contact. The area of the set of the primary carriers 13 facing away from the base layer 12 will normally be completely in contact with the respective boundary surface 16 or the respective cover layer 8 to which it is directed. However, the area of the set of the auxiliary carriers 14 will only come into contact once the primary carriers 13 are not able to fully support the compressive load exerted onto the support layer 5. If the one or more than one of the auxiliary carriers 14 comprises a convex outer surface facing away from the base layer 12, the area of the respective auxiliary carriers 14 is to be interpreted as the frontal area of said auxiliary carriers 14, wherein frontal is interpreted as perpendicular relative to the base layer 12. Thus, if the auxiliary carriers 14 are shaped as a hemisphere, the area is defined by the diameter of said sphere.

It is noted that said area may refer to a surface area of contact against a flat counter-surface. That is, the combined surface area of contact presented to a flat counter-surface by the auxiliary carriers may be larger than such combined contact area of fully loaded or compressed primary carriers.

In the embodiments shown in FIGS. 1, 2A, 2B, 3 and 8, the base layer 12 is a solid layer. However, in the even more preferred embodiments shown in FIGS. 4, 5, 6 and 7, the base layer 12 comprises recesses 19 to define cells 20 and walls 21 between said cells 20, and the primary carriers 13 extend from the walls 21 of the base layer 12. This results in improved sound insulation. If the cells 20 comprise a polygonal shape, like the hexagons in the shown embodiments defining a honeycomb pattern, the primary carriers 13 are preferably arranged at vertices of the polygonal shape. Air that is present in the cells 20 will further improve the thermal insulation properties of the support layer 5.

In view of thermal insulation capacity, it is advantageous if the cells 20 are closed or closed off on a top side thereof, thereby trapping the air with the highest temperature in the cells 20. After all, hot air has a tendency to rise. For this reason, the set of primary carriers 13 and the set of auxiliary carriers 14 is preferably arranged on the first side 15 of the base layer 12 that is configured to be placed against the boundary surface 16 of the space 1.

Figure 4:
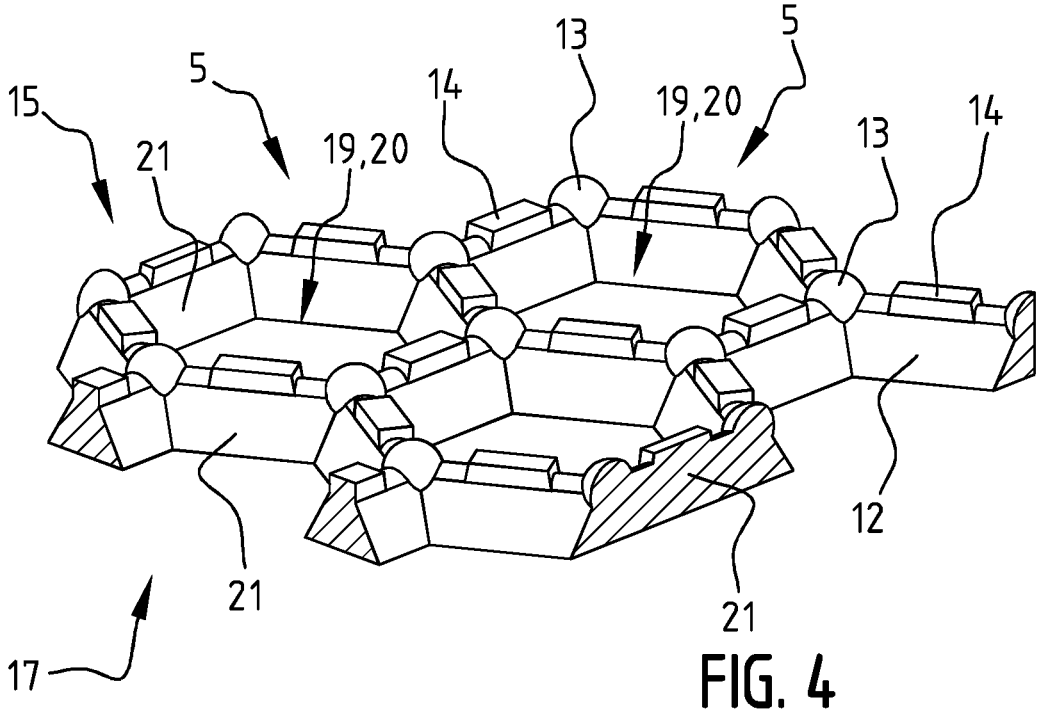
FIG. 4 is a perspective view of a support layer according to a second preferred embodiment.

In FIG. 4, the auxiliary carriers 14 also extend from the walls 21 of the base layer 12. Alternatively, the auxiliary carriers 14 may be arranged inside the cells 20.

Figure 5:
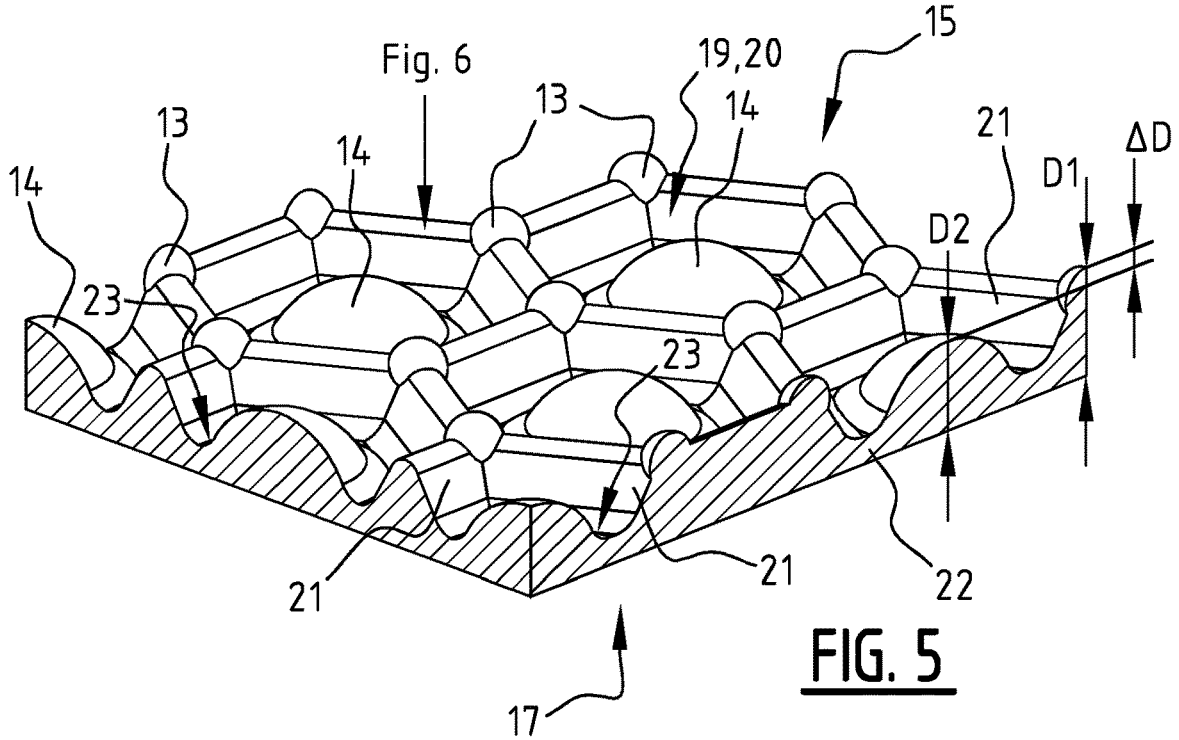
FIG. 5 is a perspective view of a support layer according to a third preferred embodiment.
Figure 6:
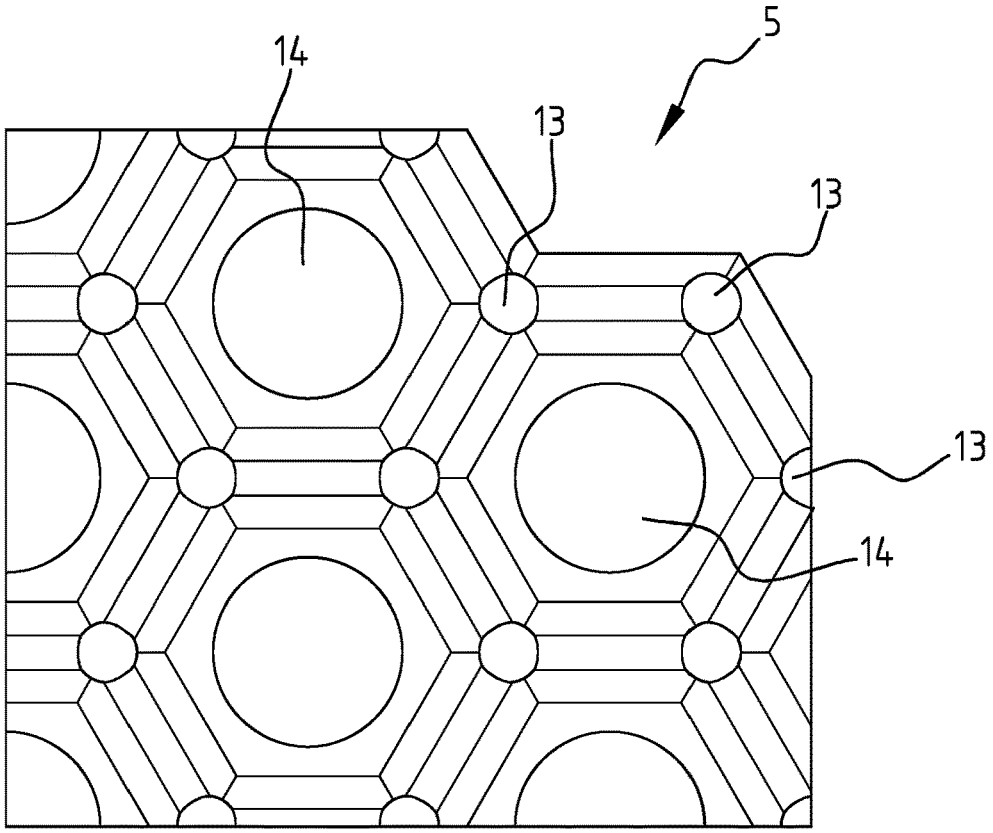
FIG. 6 is a top view of the support layer shown in FIG. 5.

In the embodiment shown in FIG. 5, the second side 17 of the base layer 12 comprises a substantially continuous surface 22 defining a bottom 23 of the cells 20. The one or more than one of the auxiliary carriers 14 extends from this bottom 23 towards the first side 15 of the base layer 12. The auxiliary carriers 14 thus extend from the bottom 23 of the cells 20 across the thickness of the base layer 12. Consequently, the auxiliary carriers 14 may be relatively high, improving the acoustic and thermal insulation properties. After all, the acoustic insulation properties may be improved because relatively high auxiliary carriers 14 may have increased compressibility. Moreover, the thermal insulation properties may be improved due to the relatively high auxiliary carriers 14 defining a thermal bridge with a relatively large thickness.

Figure 7:
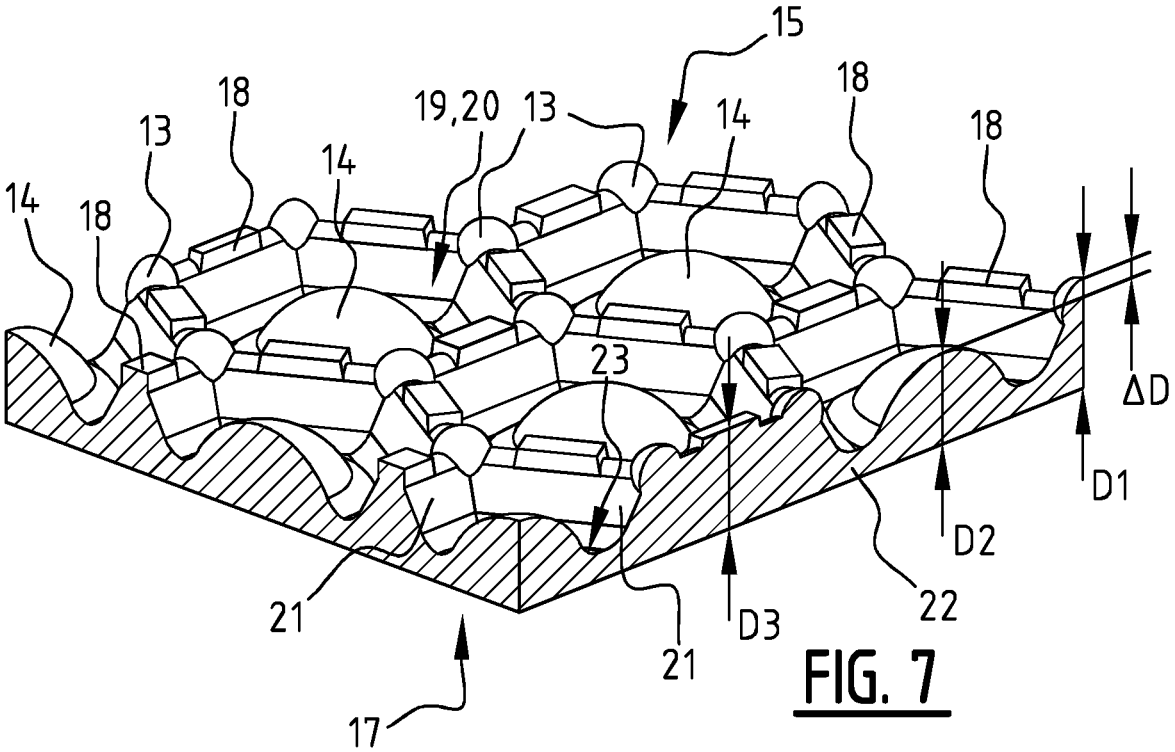
FIG. 7 is a perspective view of a support layer according to a fourth preferred embodiment that comprises one further set of auxiliary carriers.

FIG. 7, which is merely a combination of the embodiments shown in FIGS. 4 and 5, shows an even further preferred embodiment wherein the support layer 5 comprises one further set of auxiliary carriers 18 extending a smaller distance D3 than the second distance D2 from the same at least one of the first side 15 and the second side 17 of the base layer 12. If the auxiliary carriers 14 that are associated with the distance D2 are arranged in the center of the cells 20, and the even smaller further auxiliary carriers 18 that are associated with the distance D3 are arranged at the walls 21 between the cells 20, a preferred order of contact is obtained. The primary carriers 13 are in contact all of the time. When additional support for carrying the cover layer 8 is required, first the large auxiliary carriers 14 arranged in the cells 20 will contribute. As explained before, they exhibit a relatively large thickness, which is related to an improved acoustic and thermal insulation. The auxiliary carriers 14 contributing first, before the further auxiliary carriers 18 start to contribute as well, also has the advantage that the air layer between the walls 21 and the cover layer 8 is "as thick as possible", which is beneficial for the thermal insulation provided by said layer. The skilled person will however acknowledge that the position of the auxiliary carriers 14 and the further auxiliary carriers 18 may be exchanged.

When the auxiliary carriers 14 are arranged inside the cells 20, a horizontal offset between carrier positions, as defined by the combination of the primary carriers 13 and the auxiliary carriers 14, is approximately reduced by half, thereby improving the support offered by the support layer 5 to the cover layer 8 under load. This is especially advantageous near (not shown) seams of adjacent panels of the cover layer 8, such as customary in click-flooring, for example laminate, vinyl, wood-plastic composite or stone-plastic composite tiles or panels.

Further, the walls 21 themselves may define the set of auxiliary carriers 14 or one of the further sets of auxiliary carriers 18. In some implementations of the support layer 5, the distances D2 and D3 of the auxiliary carriers 14 and the further auxiliary carriers 18 or walls 21, respectively, may be the same.

The set of primary carriers 13 and the set of auxiliary carriers 14 in combination with at least one further set of auxiliary carriers 18, preferably in the form of the walls 21, can define a three-tier system configured to exert an elastic force which resists load in a progressive way. As (local) load is applied below a first threshold, the primary carriers 13 providing the smallest contact area (locally) carry all load. As said load is increased above the first threshold, the auxiliary carriers 14 may come into play to increase, preferably gradually and/or non-linearly, the contact area with their outer surface. Finally, as the load is increased to above a second threshold, the further auxiliary carriers 21, preferably in the form of the walls 21, may engage and greatly increase the contact area to effectively block further compression of the support layer. This last sudden increase of contact area upon exceeding the second threshold could also be implemented by the base layer 12 itself, without further carriers or walls to that end. However, the structure with recesses 19 defining cells 20 and walls 21 advantageously allows a certain volume of entrapped air, cushioning impact and preventing damage to the support layer 5 as well as any adjacent boundary surface 16 or cover layer 8 when load suddenly exceeds a threshold, the second threshold in this example or the first threshold when the walls 21 define the auxiliary carriers 14, e.g. in absence of any further set of auxiliary carriers 18.

In FIG. 8, the support layer 5 comprising sets of primary carriers 13 and sets of auxiliary carriers 14 arranged on both the first side 15 and the second side 17 of the base layer 12. In a preferred embodiment, a position of the primary carriers 13 arranged on the first side 15 of the base layer 12 is substantially opposite to a position of the auxiliary carriers 14 arranged on the second side 17 of the base layer 12. Likewise, preferably also a position of the auxiliary carriers 14 arranged on the first side 15 of the base layer 12 is substantially opposite to a position of the primary carriers 13 arranged on the second side 17 of the base layer 12. In this arrangement, the thermal bridge defined by the support layer 5 is minimized, because in an unloaded state, there will be an offset between the auxiliary carriers 14 and the respective boundary surface 16 or cover layer 8.

The support layer 5 can be made of a wide range of materials, including natural materials, such as wood, cork or rubber. Synthetic materials can also be used, including foam, expanded polymer core and solid polymer core. The following range of polymeric materials is deemed suitable for various applications: polyvinyl chloride, EPDM rubber, polycyclohexylenedimethylene terephthalate, (thermoplastic) polyurethane, (low-density) polyethylene and perfluorcarbone. Polymers of the elastomeric type are preferred. Composite materials are also contemplated, including stone-plastic composite, natural fibre-reinforced plastics such as wood-plastic composite, but also mineral-based materials including mineral-plastic composites or stone-plastic composites. In any case, the above materials can be used to form a resilient composition to make the support layer 5 as a monolithic piece.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments. The scope of protection is defined solely by the following claims.

The invention claimed is:

1. A support layer configured to provide at least one of acoustic and thermal insulation, comprising:

a base layer comprising a first side configured to be placed against a boundary surface of a space, and a second side configured to face away from the boundary surface and to be directed towards a cover layer;

a plurality of primary carriers configured to carry the cover layer, wherein the primary carriers are resilient and extend a first distance from at least one of the first side and the second side of the base layer; and a plurality of auxiliary carriers configured to additionally carry the cover layer when the primary carriers are compressed due to a load being exerted on the cover layer, wherein the auxiliary carriers extend a second distance, the second distance being less than the first distance, from the same at least one of the first side and the second side of the base layer;

wherein:

the base layer comprises recesses defining cells and walls between the cells;

the plurality of primary carriers extend from the walls of the base layer; and the plurality of auxiliary carriers are positioned in the cells.

2. The support layer according to claim 1, wherein each of the plurality of auxiliary carriers has a convex outer surface facing away from the base layer.

3. The support layer according to claim 1, wherein an area of the plurality of auxiliary carriers facing away from at least one of the first side and the second side of the base layer is larger than an area of the plurality of primary carriers facing away from the same at least one of the first side and the second side of the base layer.

4. The support layer according to claim 1, wherein the plurality of primary carriers and the plurality of auxiliary carriers are spaced apart from each other along the base layer.

5. The support layer according to claim 1, wherein the second side of the base layer comprises a substantially continuous surface defining a bottom of the cells.

6. The support layer according to claim 1, wherein at least one of the plurality of auxiliary carriers extends from the bottom toward the first side of the base layer.

7. The support layer according to claim 1, further comprising a further plurality of auxiliary carriers extending a distance, less than the second distance, from the same at least one of the first side and the second side of the base layer.

8. The support layer according to claim 1, wherein the walls form a further plurality of auxiliary carriers.

9. The support layer according to claim 7, wherein the plurality of primary carriers, the plurality of auxiliary carriers, and the further plurality of auxiliary carriers are positioned on only one side of the first side and the second side of the base layer.

10. The support layer according to claim 1, wherein the other of the first side and the second side of the base layer comprises a flat surface.

11. The support layer according to claim 1, wherein the plurality of primary carriers and the plurality of auxiliary carriers are positioned on the first side of the base layer that is configured to be placed against the boundary surface of the space.

12. The support layer according to claim 1, wherein the plurality of primary carriers and the plurality of auxiliary carriers are positioned on the second side of the base layer that is configured to be directed towards the cover layer.

13. The support layer according to claim 1, wherein the plurality of primary carriers and the plurality of auxiliary carriers are arranged on each of the first side and the second side of the base layer.

14. The support layer according to claim 1, wherein:

a position of the plurality of primary carriers positioned on the first side of the base layer is substantially opposite to a position of the plurality of auxiliary carriers positioned on the second side of the base layer; or a position of the plurality of auxiliary carriers positioned on the first side of the base layer is substantially opposite to a position of the plurality of primary carriers positioned on the second side of the base layer.

15. The support layer according to claim 1, wherein at least one of:

the support layer is formed as a monolithic piece;

the support layer has a thickness no greater than 5 mm; and the support layer is resilient.

16. A support layer configured to provide at least one of acoustic and thermal insulation, comprising:

a base layer comprising a first side configured to be placed against a boundary surface of a space, and a second side configured to face away from the boundary surface and to be directed towards a cover layer;

a plurality of primary carriers configured to carry the cover layer, wherein the primary carriers are resilient and extend a first distance from at least one of the first side and the second side of the base layer; and a plurality of auxiliary carriers configured to additionally carry the cover layer when the primary carriers are compressed due to a load being exerted on the cover layer, wherein the auxiliary carriers extend a second distance, the second distance being less than the first distance, from the same at least one of the first side and the second side of the base layer;

wherein:

the base layer comprises recesses defining cells and walls between the cells;

the plurality of primary carriers extend from the walls of the base layer;

the second side of the base layer comprises a substantially continuous surface defining a bottom of the cells; and at least one of the plurality of auxiliary carriers extends from the bottom of the cells towards the first side of the base layer.

17. The support layer according to claim 16, wherein each of the plurality of auxiliary carriers has a convex outer surface facing away from the base layer.

18. The support layer according to claim 16, further comprising a further plurality of auxiliary carriers extending a distance, less than the second distance, from the same at least one of the first side and the second side of the base layer.

19. The support layer according to claim 16, wherein the walls form a further plurality of auxiliary carriers.

20. The support layer according to claim 19, wherein the plurality of primary carriers, the plurality of auxiliary carriers, and the further plurality of auxiliary carriers are positioned on only one side of the first side and the second side of the base layer.

* * * * *